US008056288B2

(12) United States Patent
Denicolo'

(10) Patent No.: US 8,056,288 B2
(45) Date of Patent: Nov. 15, 2011

(54) STEP FOR MODULAR STAIRCASES AND RELATIVE STAIRCASE

(75) Inventor: Piero Denicolo', Bellaria Igea Marina (IT)

(73) Assignee: Albini & Fontanot S.p.A., Cerasolo (IT)

( * ) Notice: Subject to any disclaimer, the term of this patent is extended or adjusted under 35 U.S.C. 154(b) by 419 days.

(21) Appl. No.: 12/298,910

(22) PCT Filed: Apr. 28, 2006

(86) PCT No.: PCT/IT2006/000297

§ 371 (c)(1),
(2), (4) Date: Oct. 28, 2008

(87) PCT Pub. No.: WO2007/125551

PCT Pub. Date: Nov. 8, 2007

(65) Prior Publication Data

US 2009/0094907 A1 Apr. 16, 2009

(51) Int. Cl.
*E04F 11/00* (2006.01)

(52) U.S. Cl. ..... 52/187; 52/183; 52/185; 52/126.7

(58) Field of Classification Search ..... 52/182–185, 52/187, 126.1, 126.5–126.7
See application file for complete search history.

(56) References Cited

U.S. PATENT DOCUMENTS

| | | | | | |
|---|---|---|---|---|---|
| 340,338 | A * | 4/1886 | Marshall | 52/187 |
| 424,533 | A * | 4/1890 | Belles | 52/187 |
| 737,197 | A * | 8/1903 | Benney | 52/183 |
| 1,215,352 | A * | 2/1917 | Duvinage | 52/187 |
| 3,673,752 | A * | 7/1972 | Allen | 52/187 |
| 4,285,178 | A * | 8/1981 | Holzkampfer et al. | 52/187 |
| 4,328,880 | A * | 5/1982 | Lapeyre | 182/93 |
| 4,338,751 | A * | 7/1982 | Sanders | 52/187 |
| 4,373,609 | A * | 2/1983 | De Donato | 182/178.2 |
| 4,378,862 | A * | 4/1983 | Carmel | 182/106 |
| 4,527,367 | A * | 7/1985 | Morellini | 52/187 |
| 4,557,085 | A * | 12/1985 | Yamazaki | 52/182 |
| 5,085,020 | A * | 2/1992 | Yamazaki | 52/183 |
| 5,088,248 | A * | 2/1992 | Manna | 52/187 |
| 5,263,289 | A * | 11/1993 | Boyd | 52/220.2 |
| 5,690,871 | A * | 11/1997 | Pirotta et al. | 264/45.4 |
| 5,772,356 | A * | 6/1998 | Collins | 403/343 |
| 6,024,330 | A * | 2/2000 | Mroz et al. | 248/188.4 |
| 6,523,310 | B1 * | 2/2003 | Tseng | 52/187 |
| 2007/0000191 | A1 * | 1/2007 | Arnold | 52/187 |
| 2008/0222973 | A1 * | 9/2008 | Lee et al. | 52/126.1 |
| 2008/0236066 | A1 * | 10/2008 | Arnold | 52/187 |

FOREIGN PATENT DOCUMENTS

DE 3307650 C1 * 7/1984

(Continued)

*Primary Examiner* — Robert Canfield
*Assistant Examiner* — Charissa Ahmad
(74) *Attorney, Agent, or Firm* — Browdy and Neimark, PLLC

(57) ABSTRACT

A step for modular staircases, preferably produced by molding using a thermoplastic technopolymer, comprises at least a main body (11) and a spacer (12). The main body (11) comprises at least a tread surface (Ha) and a hollow portion (lib) extending vertically with an internal thread (111), while the spacer (12) has an external thread (121) matching that of the hollow portion (lib) of the main body (11), allowing the spacer (12) and the hollow portion (lib) to be screwed together. The hollow portion (lib) and the spacer (12) also have ends (112,122) which do not interact, shaped to match one another, to allow vertical stacking of two or more steps (10), thus obtaining a modular staircase (1), complete with a landing (20) produced in a similar way to the step (10).

10 Claims, 3 Drawing Sheets

FOREIGN PATENT DOCUMENTS

| | | | | |
|---|---|---|---|---|
| DE | 3311597 | A1 | * | 10/1984 |
| EP | 583659 | A1 | * | 2/1994 |
| GB | 2148347 | A | * | 5/1985 |
| JP | 02112551 | A | * | 4/1990 |

* cited by examiner

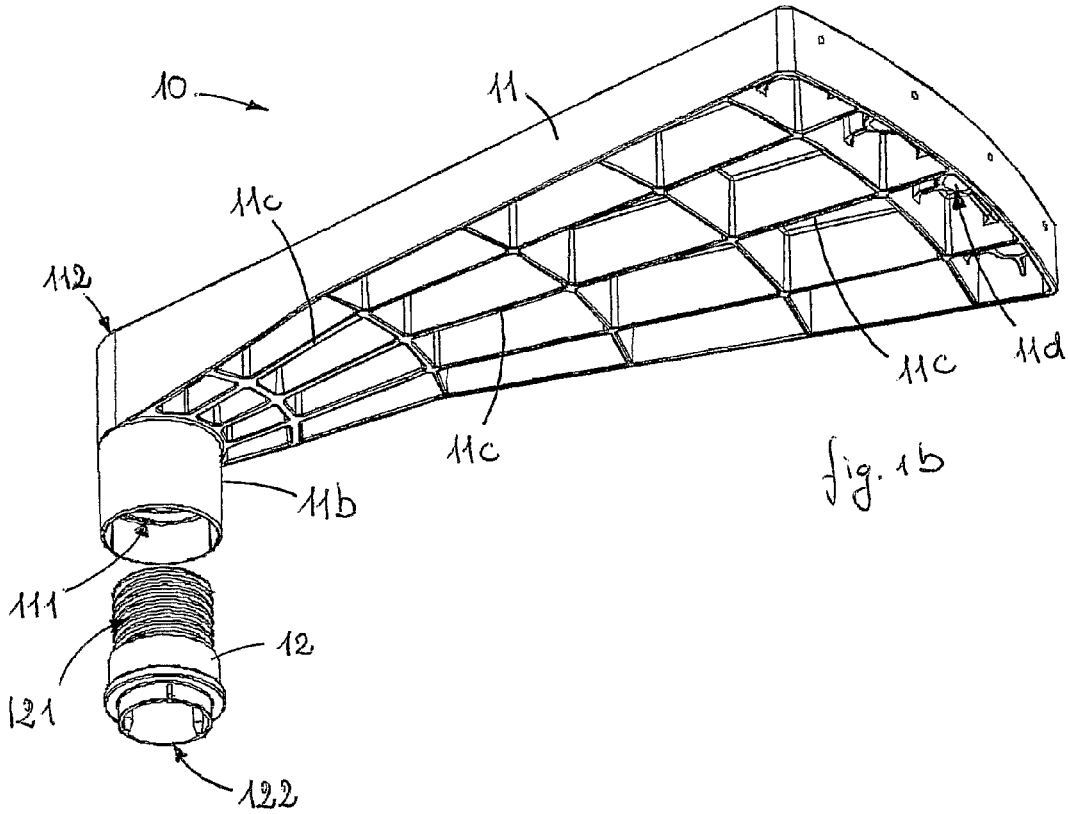
fig. 1b
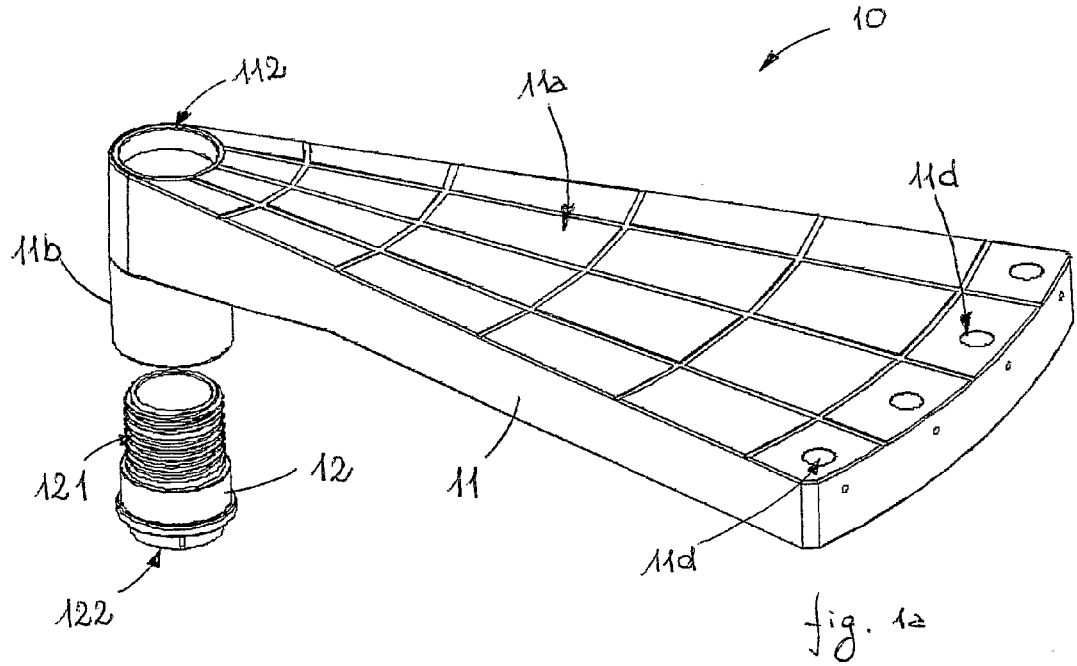
fig. 1a
FIG. 1 fig. 3a
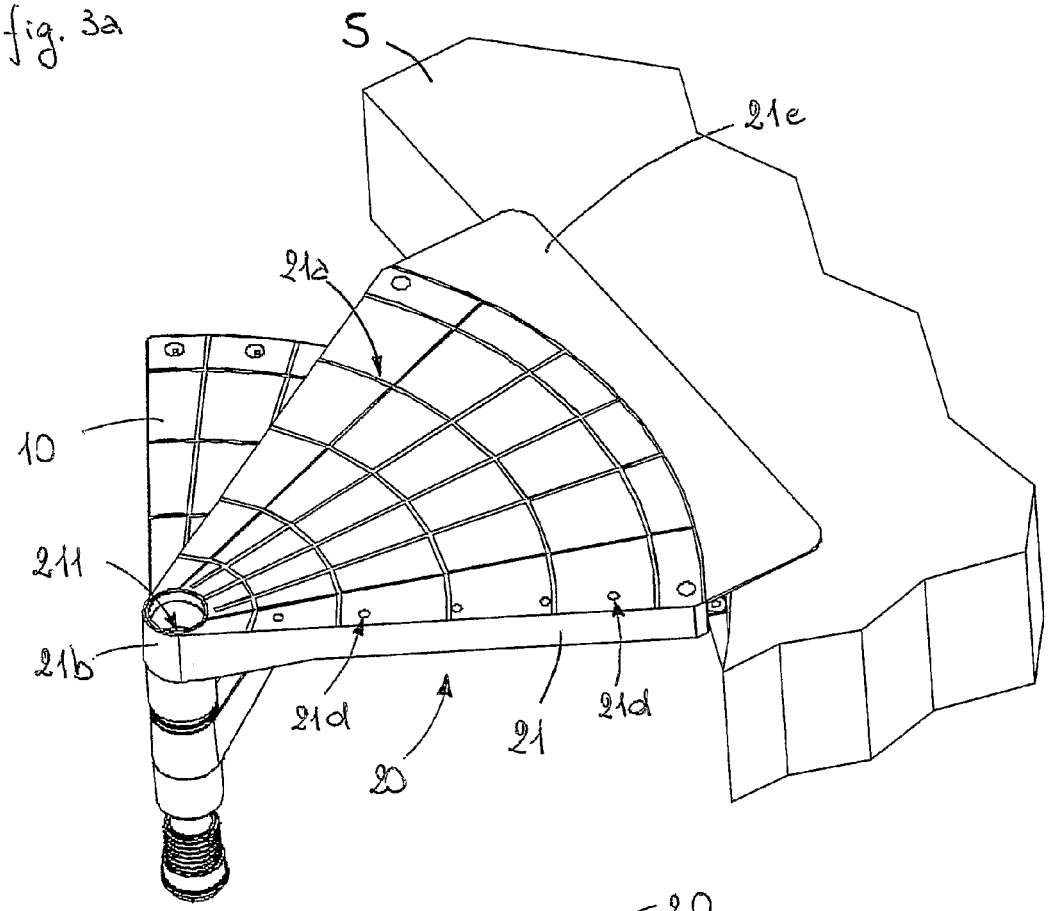
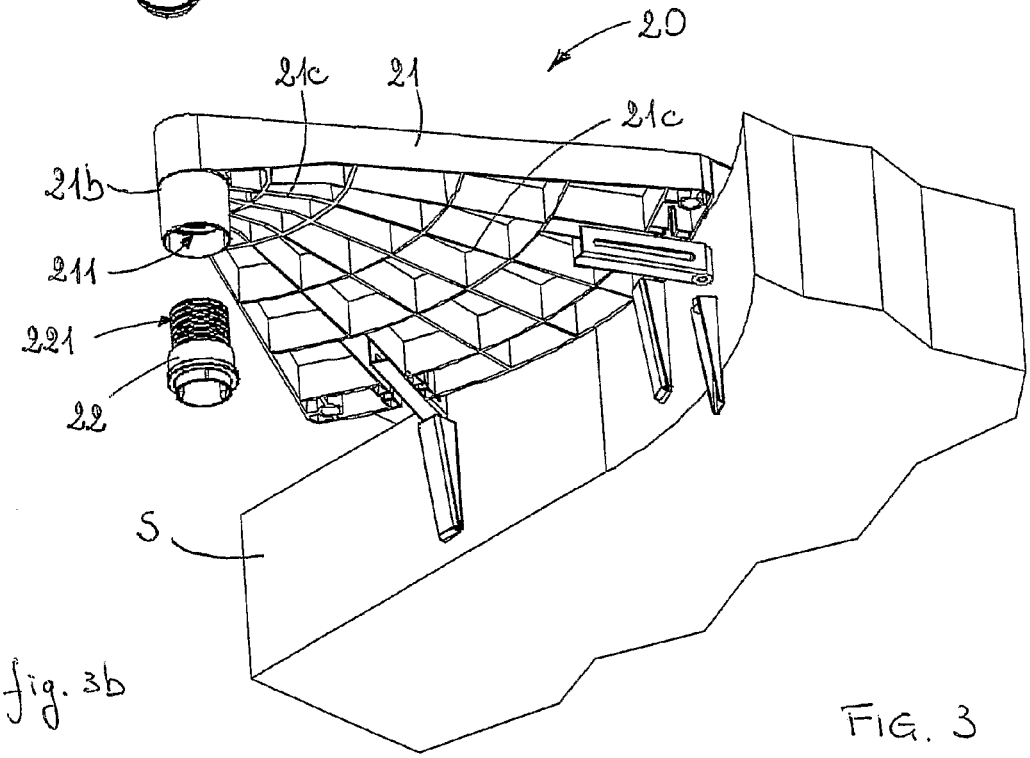
fig. 3b
FIG. 3

STEP FOR MODULAR STAIRCASES AND RELATIVE STAIRCASE

TECHNICAL FIELD

The present invention relates to a step for modular staircases and a relative staircase.

BACKGROUND ART

In the construction sector, in which problems linked to the use of ever smaller spaces are constantly faced, up to now much use has been made of modular staircases, often classed as spiral staircases and flight staircases. Both indoors and outdoors these allow the connection of rooms at different heights, using spaces which may have an extremely small footprint, or which have particular shapes. Without sacrificing the necessary safety, in the production of modular staircases, and therefore of the steps of which they consist, there are known construction techniques which allow a certain adaptability to the height which the entire staircase must cover. Since such heights may be very different, it is evident that, if a first adaptation of the staircase may be achieved according to the number of steps, only the possibility of making precision adjustments to the rise between one step and another allows production of the steps to be standardised, so that the solution to any type of potential problem is ready. The materials used to produce the steps for this type of staircase are currently wood and various types of metal alloys. Using wood, the step is first shaped to give the tread the required shape, then the various steps are stacked alternating with spacers having standard height and keyed together with the spacers on a vertical pole which acts as a tie rod, so as to keep the steps connected and make the staircase able to withstand the stresses to which it is subjected during use.

In this case, the precision adjustment is made by adding separators with limited height, also made of wood or plastic, or in any event of a material strong enough to avoid significant deformation during use. These separators are inserted between a step and a spacer at one or more points of the vertical extension of the staircase, to give the staircase the required overall height.

If a metal alloy is used instead, it is first machined into the shape of a flat sheet with limited thickness, then drawn and bent to give the step the required shape. Then the edges are trimmed and the step is welded to a portion of tube which helps to cover the pole which acts as a tie rod. Finally, it is cleaned and painted to give it the predetermined appearance.

In this case too, precision adjustment may be carried out using a spacer consisting of two end ring nuts, also useful for centering the pole in the tube. Connected to one of the ring nuts is a smooth shank, on which a predetermined number of separators, similar to those previously described, may be inserted, to separate the two ring nuts, and so also two consecutive steps, by the required distance. Alternatively, a threaded shank may be integral with one of the two ring nuts. The other ring nut may be screwed onto the threaded shank, so as to make the adjustment by interrupting the screwing on action at the required point and without having to use the above-mentioned separators.

In both solutions, that is to say, whether using wood or metal alloys to produce the modular staircase, the elements used for the precision adjustment are at least partly visible, and this is often disadvantageous in terms of appearance, creating gaps in the shapes of the step, especially if the part visible comprises portions of the thread.

Moreover, at least if metal alloys are used, further processing is required, for example, painting, deburring and sandblasting, which in some cases may be carried out even after assembly and which in any event extend production times and increase costs.

DISCLOSURE OF THE INVENTION

The aim of the present invention is, therefore, to eliminate the above-mentioned disadvantages. The present invention, as described in the claims, achieves the aim by integrating the rise adjustment system in the step.

The main advantage of the present invention is basically the fact that the staircase maintains the continuity of its lines, irrespective of height adjustments which are made by acting on the step, giving the product a uniform appearance.

Moreover, the materials preferably used, consisting of technopolymers with thermoplastic properties, allow steps to be produced with the injection moulding technique, avoiding both particularly complex machining, such as internal threads, and the need for finishing operations after assembly.

Finally, use of this production technique allows a variety of shapes, sizes and colours which extends the choice for the public without increasing the relative costs.

BRIEF DESCRIPTION OF THE DRAWINGS

Further advantages and features of the invention are more evident in the detailed description which follows, with reference to the accompanying drawings, which illustrate a preferred embodiment without limiting the scope of the invention, in which:

FIG. 1 is a perspective top view (FIG. 1*a*) and a perspective bottom view (FIG. 1*b*) of the invention;

FIG. 3 shows details of the invention, with some parts cut away to better illustrate others.

DETAILED DESCRIPTION OF THE PREFERRED EMBODIMENTS OF THE INVENTION

Figure 2:
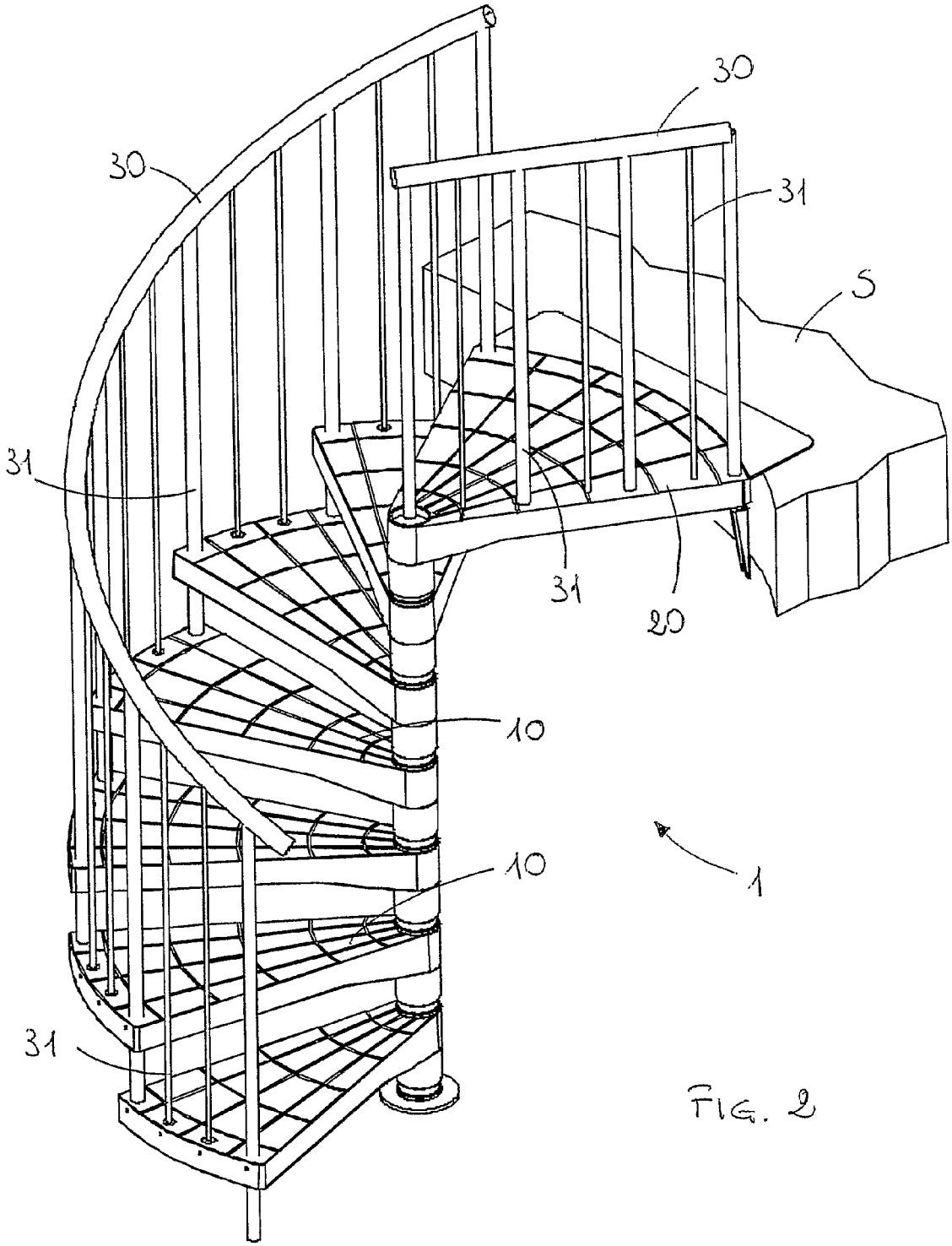
FIG. 2 is a perspective view of the invention in a condition of use.

As shown in the accompanying drawings, the invention relates to a step for modular staircases and a corresponding modular staircase, which can be obtained using a plurality of said steps.

The step 10, illustrated in FIG. 1, comprises a main body 11, in turn consisting of at least a tread surface 11*a* and a hollow portion 11*b* extending vertically with an internal thread 111, and a spacer 12, with an external thread 121 matching the thread 111 of the hollow portion 11*b* of the main body 11. In this way, screwing the spacer 12 and the hollow portion 11*b* together gives the overall rise corresponding to the single step 10, which may be modified relative to a reference value by simply screwing one onto or unscrewing one off the other a little more or a little less. The two ends 112, 122 of the hollow portion 11*b* of the main body 11 and the spacer 12 which do not interact are also shaped to match one another, to allow vertical stacking of two or more steps 10.

As already indicated, the material used to produce the steps 10 may be arbitrary, in the sense that they may be made of wood, metal alloys or plastics. However, it should be noticed that it is technically difficult to produce internal threads 111 using metal alloys, both during forming and after a die-casting process, and not all of the above-mentioned problems, relative to further operations after assembly, can be solved. Moreover, wood does not adapt well to standardised industrial processes, whilst its use is more in keeping with high quality craftsmanship. For this reason, the main advantages deriving from use of the present invention are obtained using a technopolymer with thermoplastic properties, so that the step 10 can be produced by injection moulding. The main advantage linked to such a material derives from the fact that, once the moulding is complete, no further processing of any type is required: in particular, the product obtained in this way may allow maximum possibilities in terms of the choice of shapes, sizes and colours. For example, the threaded hollow portion 11*b* could have an internal part which has to be cylindrical which is covered by, or connected to, an external part which may have any shape.

Another advantage linked to use of a technopolymer with thermoplastic properties, and the moulding technique which may be used, is the fact that the main body 11 of the step 10 produced in this way comprises stiffening ribs 11*c*, visible in FIG. 1*b*, produced in a single body with the tread surface 11*a*. Moreover, the main body 11 comprises at least one shaped seat 11*d*, also produced in a single body with the tread surface 11*a*, designed to house at least one corresponding element 31 of a banister 30.

In addition to the individual step, similar advantages may derive from production of a modular staircase 1, illustrated in FIG. 2, for example of the spiral or flight type, which comprises a plurality of steps 10 in accordance with the foregoing claims.

The modular staircase 1 produced in this way also comprises a landing 20, illustrated in the details in FIG. 3. Similarly to the step 10, the landing 20 comprises at least a main body 21 and a spacer 22. The main body 21 comprises at least a tread surface 21*a* and a hollow portion 21*b* extending vertically with an internal thread 211; the spacer 22 has an external thread 221 matching the thread 211 of the hollow portion 21*b* of the main body 21, allowing the spacer 22 and the hollow portion 21*b* to be screwed together.

The main body 21 of the landing 20 also comprises an outer edge 21*e* of the tread surface 21*a*, designed to adapt the landing 20 to holes in a floor S having any profile.

In the most advantageous version, corresponding to use of a technopolymer with thermoplastic properties for the entire staircase 1, the main body 21 of the landing 20 also has stiffening ribs 21*c*, produced in a single body with the tread surface 21*a*, as well as at least one shaped seat 21*d*, also produced in a single body with the tread surface 21*a*, designed to house at least one corresponding element 31 of a banister 30.

The invention described may be modified and adapted without thereby departing from the scope of the inventive concept. Moreover, all details of the invention may be substituted by technically equivalent elements.

Obviously, in practice modifications and/or improvements are possible, all covered by the claims herein.

The invention claimed is:

1. A step for modular staircases, characterised in that it comprises at least a main body (11), comprising at least a tread surface (11*a*) and a hollow portion (11*b*) with an internal thread (111), and a spacer (12), with an external thread (121) matching the thread (111) of the hollow portion (11*b*) of the main body (11), allowing the spacer (12) and the hollow portion (11*b*) to be screwed together, the portion (11*b*) and the spacer (12) also having non-interacting ends (112, 122) shaped to match one another, allowing the vertical stacking of two or more steps (10).

2. The step according to claim 1, characterised in that it consists of a technopolymer with thermoplastic properties, so that it can be produced by injection moulding.

3. The step according to claim 2, characterised in that the main body (11) comprises stiffening ribs (11*c*) produced in a single body with the tread surface (11*a*).

4. The step according to claim 2, characterised in that the main body (11) comprises at least one shaped seat (11*d*) produced in a single body with the tread surface (11*a*), designed to house at least one corresponding element (31) of a banister (30).

5. A modular staircase, characterised in that it comprises a plurality of steps (10) according to claim 1.

6. The modular staircase according to claim 5, characterised in that it comprises a landing (20).

7. The modular staircase according to claim 6, characterised in that the landing (20) comprises at least a main body (21), comprising at least a tread surface (21*a*) and a hollow portion (21*b*) extending vertically with an internal thread (211), and a spacer (22), having an external thread (221) matching the thread (211) of the hollow portion (21*b*) of the main body (21), allowing the spacer (22) and the hollow portion (21*b*) to be screwed together.

8. The modular staircase according to claim 7, characterised in that the main body (21) of the landing (20) comprises an outer edge (21*e*) of the tread surface (21*a*), designed to adapt the landing (20) to holes in a floor (S) having any profile.

9. The modular staircase according to claim 7, characterised in that the main body (21) of the landing (20) comprises stiffening ribs (21*c*) produced in a single body with the tread surface (21*a*).

10. The modular staircase according to claim 6, characterised in that the main body (21) of the landing (20) comprises at least one shaped seat (21*d*) produced in a single body with the tread surface (21*a*), designed to house at least one corresponding element (31) of a banister (30).

* * * * *